US009138699B2

(12) United States Patent
Kulkarni et al.

(10) Patent No.: US 9,138,699 B2
(45) Date of Patent: Sep. 22, 2015

(54) FRACTAL IMPELLER FOR STIRRING

(75) Inventors: Amol A. Kulkarni, Pune (IN); Bhaskar Datttraya Kulkarni, Pune (IN)

(73) Assignee: COUNCIL OF SCIENTIFIC & INDUSTRIAL RESEARCH, New Delhi (IN)

( * ) Notice: Subject to any disclaimer, the term of this patent is extended or adjusted under 35 U.S.C. 154(b) by 4 days.

(21) Appl. No.: 13/449,060

(22) Filed: Apr. 17, 2012

(65) Prior Publication Data

US 2013/0208560 A1 Aug. 15, 2013

(30) Foreign Application Priority Data

Feb. 13, 2012 (IN) ..... 0390/DEL/2012

(51) Int. Cl.
*B01F 7/32* (2006.01)

(52) U.S. Cl.
CPC ..... *B01F 7/32* (2013.01)

(58) Field of Classification Search
CPC ..... B01F 5/0601; B01F 15/0264; B01F 7/32
USPC ..... 366/342–343, 325.1, 329.1, 329.2
See application file for complete search history.

(56) References Cited

U.S. PATENT DOCUMENTS

| | | | | |
|---|---|---|---|---|
| 25,329 | A * | 9/1859 | Haeckel | |
| 1,103,271 | A * | 7/1914 | Crump | 366/129 |
| 1,409,259 | A * | 3/1922 | Sykora | 239/565 |
| 1,465,036 | A * | 8/1923 | Dietz | 68/134 |
| 4,175,875 | A * | 11/1979 | Van Horbek | 366/343 |
| 4,238,159 | A * | 12/1980 | Tielens et al. | 366/327.2 |
| 5,716,132 | A * | 2/1998 | Chou | 366/129 |
| 5,938,333 | A * | 8/1999 | Kearney | 366/336 |
| 6,333,019 | B1 * | 12/2001 | Coppens | 423/659 |
| 6,616,327 | B1 * | 9/2003 | Kearney et al. | 366/340 |
| 6,742,924 | B2 * | 6/2004 | Kearney | 366/336 |
| 7,014,442 | B2 * | 3/2006 | Haynes et al. | 425/131.5 |
| 7,390,408 | B2 * | 6/2008 | Kearney et al. | |
| RE42,882 | E * | 11/2011 | Kearney | 366/336 |
| 8,485,716 | B2 * | 7/2013 | Handa | 366/270 |
| 2002/0080563 | A1 * | 6/2002 | Pence et al. | 361/676 |
| 2002/0196706 | A1 * | 12/2002 | Kearney | 366/336 |
| 2004/0213084 | A1 * | 10/2004 | Kearney | 366/336 |
| 2005/0000879 | A1 * | 1/2005 | Kearney et al. | 210/287 |
| 2007/0297285 | A1 * | 12/2007 | Cross et al. | 366/340 |
| 2012/0305549 | A1 * | 12/2012 | Wylie | 219/726 |
| 2013/0208560 | A1 * | 8/2013 | Kulkarni et al. | 366/343 |

FOREIGN PATENT DOCUMENTS

| | | | | |
|---|---|---|---|---|
| WO | WO 9000930 | A1 * | 2/1990 | B01F 7/30 |

* cited by examiner

*Primary Examiner* — Charles Cooley
(74) *Attorney, Agent, or Firm* — Gottlieb, Rackman & Reisman, PC

(57) ABSTRACT

A fractal impeller design for stirred tank reactors comprising plurality of main branches, each of which further having plurality of sub-branches with each sub branch having plurality of blades to distribute/dissipate energy in uniform manner and to achieve uniform temperature throughout the reactor while operating it at lower impeller speed to avoid high shear zones; wherein, the angular distances covered by the blades vary and yield variation in the local blade passage velocity for a given impeller rotation speed.

11 Claims, 15 Drawing Sheets

FRACTAL IMPELLER FOR STIRRING

FIELD OF THE INVENTION

The present invention relates to impellers used in stirred tank reactors. More particularly, the present invention relates to a fractal impeller which reduces the non-uniformity of a reaction mass and develops uniform randomness throughout a reactor.

BACKGROUND OF THE INVENTION

Stirred tank reactors (STR) form an integral component of chemical, pharmaceutical, and the fermentation industries. These types of reactors have been in operation for last several decades and a number of investigators have analyzed them in detail to optimize the designs based on the power consumption, mass and heat transfer, and the internal hydrodynamics. In the stirred reactors, energy is supplied in the form of a kinetic energy by rotating the impeller at desired speed. STRs have largely been used for (i) mixing or blending of two miscible liquids, (ii) generation of dispersions for gas-liquid and liquid-liquid reactions, (iii) keeping the solid particles in suspension to facilitate the solid fluid contact to achieve solid dissolution, (iv) crystallization, etc. The energy requirement of these processes forms a significant part of the total energy and contributes toward major expenses. Thus, the efficiency of a stirred tank reactor mainly depends on the impeller design and its location in the stirred reactor.

U.S. Pat. No. RE42882 provides a method and apparatus for rapid and homogeneous mixing or reacting a fluid mixture, wherein two or more independent and offset fluid transporting fractals allow the scaling and intermingling of two or more fluids separately and simultaneously prior to contacting the fluids with one another, the geometry of one fractal is different from the geometry of a second fractal. Fractals are constructed using an initiator structure, or parent structure, with self-similar structure added at smaller and smaller scales in the form of an "H". Furthermore, one of the fractals is bifurcated at an angle between perpendicular and parallel to a flow direction of the inlet of that fractal. However turbulence inducing mechanical mixing devices, such as impellers, blenders, and impinging devices, is not used in U.S. Pat. No. RE42882.

International Publication No. WO9948599 provides fractal structures arranged to minimize the intersection of recursive fluid flow paths which comprises an improved fluid transporting fractal. A notable feature of the structures of this invention is the positioning of fractal stages along the direction of flow wherein stages of either progressively smaller or progressively larger scales are arranged serially in the direction of flow that lower the turbulence.

Mike Kearney in Chem. Eng. Comm. Vol. (1), 1999 describes applications of engineered fluid transporting fractals which include use as alternatives to turbulence, controlled formation of fluid geometry, broad range of fluid control and rapid transition of effective fluid dimension.

Further. Patrick Spicer in the Journal of Colloid and Interference Science 184, 112-122 (1996) 0601 discloses the effect of impeller type and shear rate on the evolution of floe size and structure during shear-induced flocculation of polystyrene particles with aluminum sulfate which is investigated by image analysis. The concepts of fractal geometry are used to characterize the floc structure.

Additionally, Joel J. Ducoste, in AIChE 43 (2), 328-338, 1997 describes effects of tank size and impeller type for STRs, wherein turbulence intensity increases with increasing tank size regardless of impeller type. U.S. Pat. Pub. No. 2007/0299292 and U.S. Pat. Pub. No. 2010/0307665 describe different fractal patterns for STRs.

Typically (except for the highly viscous fluids), the system operates in turbulent regime. Usually, the distribution of energy dissipation is considerably heterogeneous. Thus, for instance, for a paddle mixer, 90% of the input energy is dissipated below the impeller while the remaining 10% is dissipated above the impeller. Also, for a pitched blade down flow turbine (PBTD), 30% energy is dissipated in the impeller region, 57% below the impeller and just 13% above the impeller. Usually, the impeller region is the most active zone of the reactor and also a region yielding high transient shear gradients. Thus, uniform spatial distribution of energy is difficult to achieve in the conventional STRs. Also, for achieving uniform temperature throughout the reactor while operating it at lower impeller speed to avoid high shear zones (mainly for shear sensitive media), the conventional impellers may not be applicable.

Therefore, there is a need in the art to look for alternatives that would make the entire reactor active in a hydro-dynamically similar manner. Thus, it is an objective of the invention to provide an efficient impeller to achieve uniformity throughout the stirred tank that can yield better mixing and low shear at relatively low power consumption.

Objective of the Invention

The main objective of the present invention is to develop a fractal impellers for stirred tank reactors which obviates the drawback of the hitherto known prior art as detailed above.

Another objective of the present invention is to provide an efficient impeller to achieve uniformity throughout the stirred tank that can yield better mixing and low shear at relatively low power consumption.

SUMMARY OF THE INVENTION

In accordance with the above, the invention discloses a new impeller that occupies less than 0.4% of the volume of the reactor, which is similar to the conventional impeller system, but spreads, over almost the entire vessel, yielding a structure with relatively large voids. Accordingly, the instant invention provides an impeller with fractal design to achieve uniformity throughout the stirred tank and can yield better mixing and low shear at relatively low power consumption. Accordingly, in an embodiment, the present invention provides a fractal impeller for stirred tank reactors comprising a shaft rotatable about an axis, a plurality of main branches that are directly connected to a shaft. Each of said main branches are split into plurality of sub-branches each sub-branch has a plurality of blades and the said blades of each sub-branch are arranged in a manner that two blades are orientated in horizontal positions and the remaining two blades are orientated in vertical positions. In an embodiment, a plurality of first sub-branches are connected to the main branches with each of the first sub-branches having a plurality of blades connected thereto, including a first blade, a second blade, a third blade and a fourth blade, with the first blade and the second blade of each of the first sub-branches orientated perpendicular to the axis and the third blade and the fourth blade of each of the first sub-branches orientated parallel to the axis and at least one second sub-branch that is directly connected to the shaft near one end of the shaft to aid in generating necessary flow in a region close to a bottom of the stirred tank reactor.

In an embodiment of the present invention, said impeller has at least three main branches and at least three sub-branches with each sub-branch having at least four blades.

In yet another embodiment of the present invention, the blade of the impeller is made of a flat or perforated sheet of different shapes, sizes and numbers.

In yet another embodiment of the present invention, the shape of the blade can be rectangular, triangular, and circular and twist between 08 to 16 degrees.

In yet another embodiment of the present invention, the fractal impeller comprises an additional sub-branch that is provides at the bottom of the impeller.

In still another embodiment of the present invention, the branches are attached at the same location along the shaft length and the attachment distance is between 0.5 to 0.66 times the lengths of shaft.

In still another embodiment of the present invention, for the stirred tanks having aspect ratio greater than 1, the number of branches are equal to or lesser than the ratio of fluid height to tank diameter in the reactor.

In yet another embodiment of the preset invention, the power number ranges between from 0.35 to 0.6.

In still another embodiment of the present invention the operating speed of impeller is in the range of $1.66<N<3.33$ rotations per second.

In still another embodiment of the present invention, the diameter of the fractal impeller (DFI) follows the formula, DFI=T/1.58 where T is stirred tank height.

In yet another embodiment of the present invention, a steel ball (6 mm diameter) is sandwiched between the bottom of the shaft and the center of the vessel bottom.

In an embodiment, the blades are spaced from each other and do not overlap each other.

Thus, the invention provides a plurality of blades to distribute/dissipate energy in uniform manner and to achieve uniform temperature throughout the reactor and the angular distances covered by the blades vary and yield variation in the local blade passage velocity for a given impeller rotation speed

DETAILED DESCRIPTION OF THE INVENTION

The present invention is directed to a fractal impeller having self-similarity in the geometry of an impeller at different scales to provide self-similar distribution of energy to achieve uniformity in the flow properties in a STR. It is known that for mixing at small scale, generation of local chaotic advection by different mechanisms including the mechanical movements helps to achieve better mixing. FIG. 1A illustrates a front view of the fractal impeller and FIG. 1B illustrates a top view of the fractal impeller.

The invention provides a fractal impeller design for stirred tank reactors comprising plurality of main branches 2 that are attached with a shaft 1. Each of the main branches has a plurality of sub-branches 3 with each sub-branch having plurality of blades 4 to distribute energy in uniform manner and to achieve uniform temperature throughout the reactor while operating it at lower impeller speed to avoid high shear zones wherein, the angular distances covered by the blades vary and yield variation in the local blade passage velocity for a given impeller rotation speed.

Figure 1B:
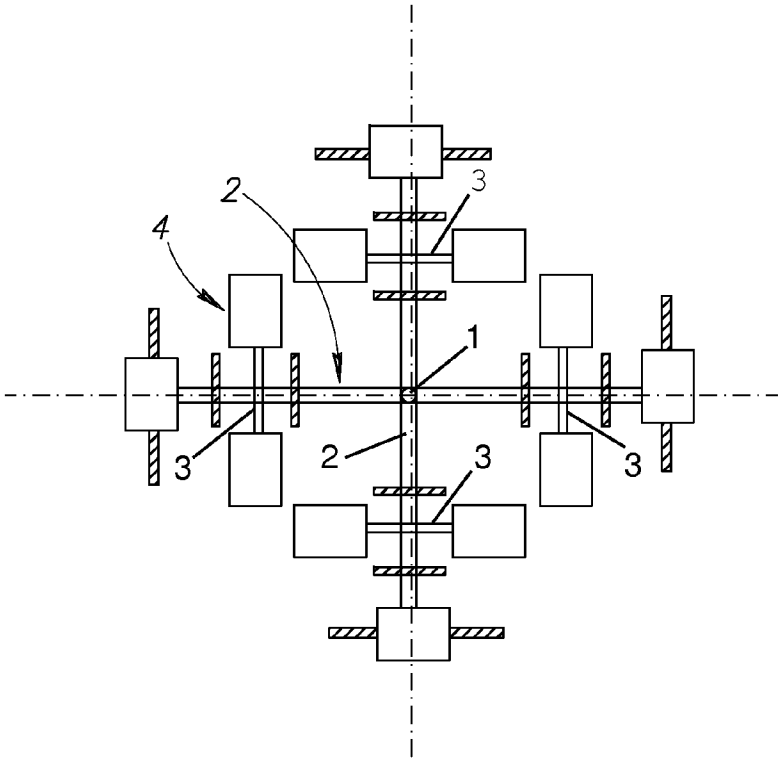
FIG. 1B depicts a top view schematic diagram of the fractal impeller.
Figure 1A:
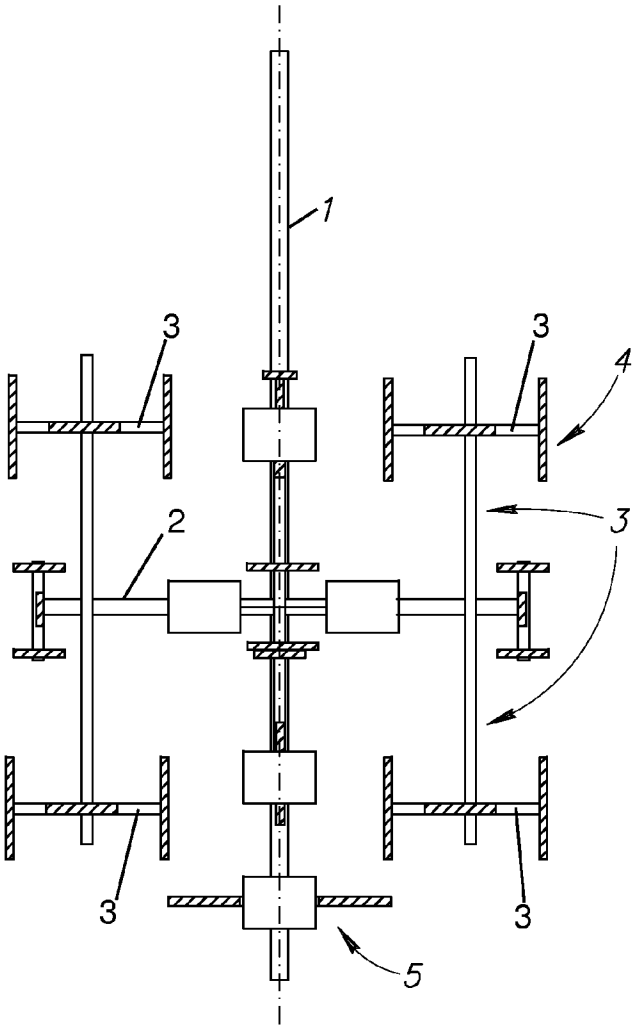
FIG. 1A depicts a front view schematic diagram of the fractal impeller.

According to a preferred embodiment as shown in FIGS. 1A and 1B, the impeller has four main branches, each of which is split further into three sub-branches. On each of such sub-branch four blades have been provided, of which two blades are horizontal and the remaining two are vertical. Importantly, in the entire design, the orientation of the blades is kept such that none of the blades actually sweep any liquid with them, but simply fragment the fluids they pass through it. An additional sub-branch 5 at the bottom of the impeller as provided in FIGS. 1A and 1B helps to generate the necessary flow in the region close to the tank bottom. Also, for a given impeller rotation speed, the angular distances covered by the blades vary and yield variation in the local blade passage velocity. However with the confined nature of the entire system, such variations do not make significant effects on the flow uniformity.

EXAMPLES

The following examples are given by way of illustration and therefore should not be construed to limit the scope of the present invention.

Example 1

The experiments were carried out in an acrylic stirred tank (T=H=0.3 m) with a single impeller system. The vessel was fitted with four baffles (width, W=T/10). The impeller shaft was connected to a DC motor via a shaft mounted torque transducer. Experiments were carried out with three different impellers: 6 blade-disk turbine (IT), 6 blade-pitched blade down flow turbine (PBTD), and the fractal impeller (FI). For DT and PBTD, the impeller diameter was D=–T/3=100 mm, and the off-bottom clearance (C) was equal to T/3. The FI was supported from the bottom by making a counter groove on the shaft (FIG. 1D) and for the FI, diameter of fractal impeller (DFI)=T/1.58. A steel ball (6 mm diameter) was sandwiched between the bottom of the shaft and the center of the vessel bottom. The volume of the liquid inside the reactor was 21.2 L for all experiments. The solidity of all the impellers was maintained in a close range.

The experiments were carried out to compare the performance of the FI with the conventional impellers, vis DT and PBTD. To facilitate such a comparison, the power consumption by the impeller, the mixing characteristics, and the efficacy of suspending the particles and making gas liquid dispersion were considered as the measurable parameters.

(a) Power Consumption (P):

Power draw can be measured using various methods. In the current experiments we used a rotary torque transducer (C Time Sync, UK). These transducers are no contact optical devices, which function using the displacement principle causing a variation of volume of light. Depending upon the extent of torsion experienced by the impeller shaft during its motion, a proportional volume of light is generated by a low power demand solid state laser. This volume of light is captured by the optical components attached to the transducer torsion shaft, and the value helps us to know the torque experienced for a given impeller rotation speed. An in-built shaft encoder helps to monitor the impeller rotation speed. Signal processing is done within the transducer, and the transducer can be fixed either by base flange or in-line, between suitable couplings. The torque data were acquired online on a computer (PC) using a data acquisition system and were later subjected to Fourier analysis to identify the possible dominant frequencies that would affect the flow and which may be characteristics to the impeller.

The FI impeller structure was given a support at the bottom. It was seated on a steel ball and was seen to have a very smooth motion without offering any significant friction due to the contact between the impeller bottom and the steel ball, and thus the measured torque was entirely due to the friction experienced by the impeller.

Figure 2A:
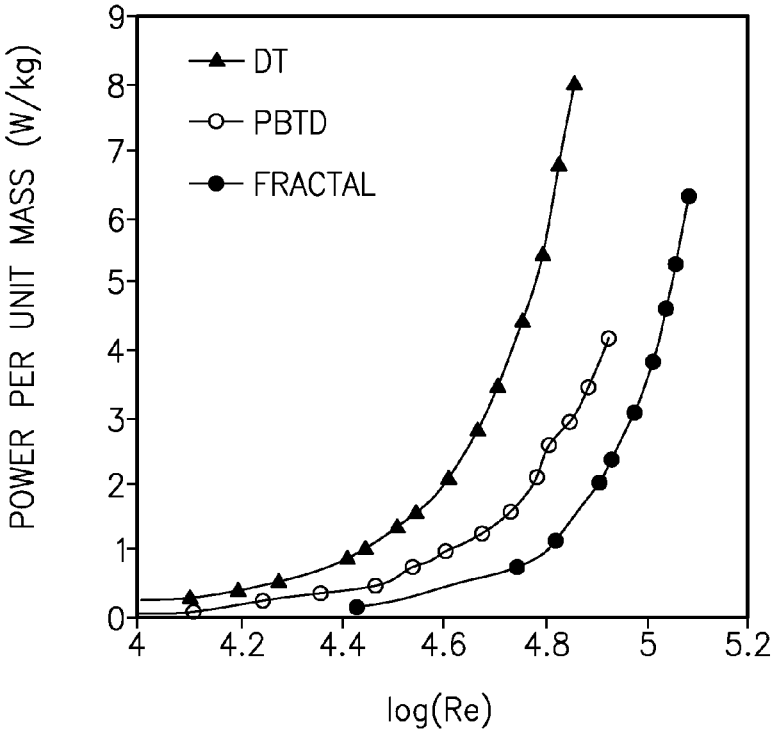
FIG. 2A graphically depicts variation in the power consumed per unit mass (PW) with impeller Reynolds number (Re) for different impellers under consideration.

The power consumption (P) by the impeller was estimated using the measured torque data ($\tau$) at different impeller rotation speeds as $P=2\pi\tau N$, where N is the impeller rotation speed (per second). Subsequently the volumetric power draw (P/V) and the power consumption it mass PW (W/kg) were calculated. The impeller power number NP was estimated as $NP=P/(\rho_L N^3 D^5)$, where $\rho_L$ is the bulk fluid density (estimated by taking into account the dispersed phase properties). Typical variation in PW with increasing impeller Reynolds number ($Re=ND^2\rho/\mu$) showed power law relations (FIG. 2A).

Figure 2B:
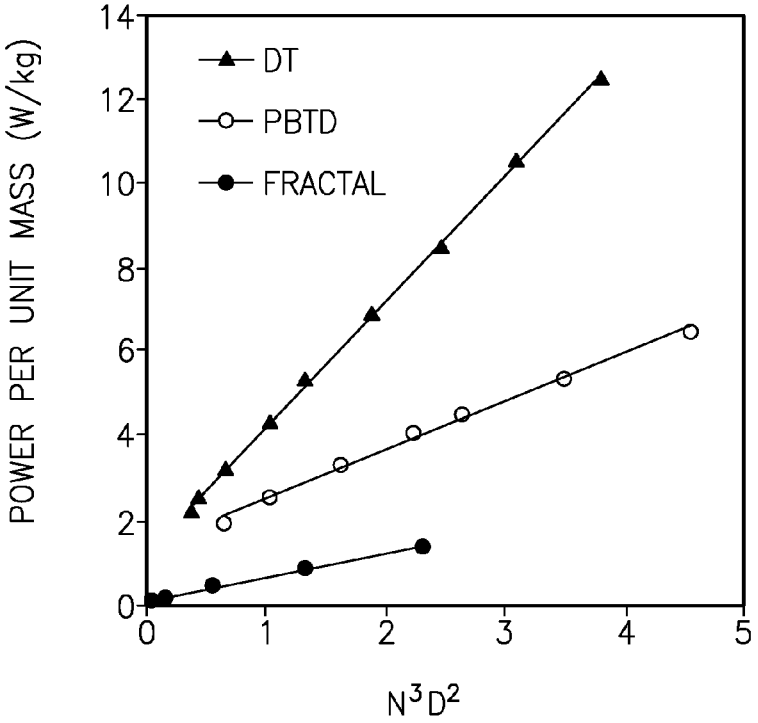
FIG. 2B graphically depicts variation in the power consumed per unit mass (PW) vs. $N^3D^2$.
Figure 2C:
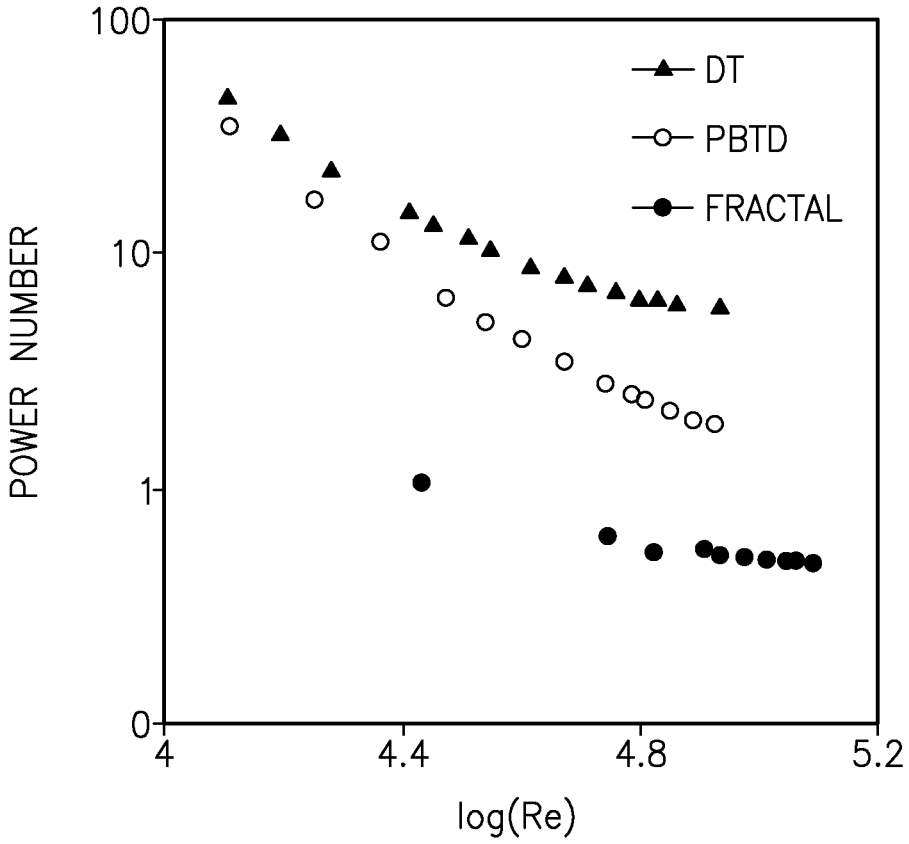
FIG. 2C graphically depicts variation in the Power Number (PW) vs. log of the impeller Reynolds number (Re)

Since the energy dissipation per unit mass or the energy draw scales as $N^3D^2$ in the turbulent regime, the plot of PW vs $N^3D^2$ showed positive relationship for all the three impellers. Interestingly, while the linear relation exists for the DT and PBTD in the turbulent regime, for the FI, a linear variation was noticed for the entire range of impeller rotation. While the values of the intercept for the linear straight line for DT and PBTD were very close (FIG. 2B), the slope of the relation for DT was higher than that for PBTD. For the FI, the intercept as well as the slope were very small as compared to the other two impellers. This indicates that the overall energy draw with the FI is much lesser than that for the other two impellers. In other words, at identical Re, PW for the FI is lower than the conventional impellers. For the present calculations, we have used the actual lateral distance between the farthest blades as the impeller diameter (D). On estimating the power number for these cases (FIG. 2C), the NP value for a single DT independent of Re was 6.014 (which is close to the value known for standard DT: 6), while for the PBTD of the same dimensions and standard geometry, NP independent of Re was 1.84. However, for identical rotation speed of the FI, the Re was much higher due to larger diameter, and the value of NP independent of Re was 0.38, which is much lower than the NP for DT and PBTD. Thus, beyond the critical Re, PW, FI is lower by many times that of the conventional impellers. One of the reasons for such lower power consumption is the lack of significant energy dissipation gradients in the tank as they exist for the conventional impellers and where the energy dissipation occurs due to the cascading process originating from large eddies. The presence of uniform structure helps to maintain similarity in the flow throughout thus making the energy distribution uniform. Moreover, since there are no fluid sweeping blades, the formation of large eddies is avoided, and the impeller basically cuts the fluid continuously.

This practically eliminates the typical energy dissipation and shear zones observed in conventional impellers. Also, the absence of any wakes behind the blades helps further reduce the drag and hence the energy consumption. Reduction in the contact area of the impeller also helps to decrease the extent of form and skin drag. The design yields stream lines that would follow the flow separation over the blades and interaction with other streamlines in the compartments formed due to self-similar feature. This specifically reduces the value of form drag to a great extent, and also the possibility of any wake formation behind the blade is almost zero. However, continuous passage of blades in the same plane helps develop local circulation zones restricted to the blade dimensions thereby creating several similar local circulating zones that interact with each other.

(b) Mixing Time ($\theta$Mix):

The mixing time was measured by giving a tracer (of 0.3% of the total reactor volume) in the form of concentrated salt solution (1 M, NaCl in the form of pulse of) at the liquid surface. The tracer concentration was measured in time using the conductivity probe (connected to a standard conductivity electrode with cell constant of 1.0 along with a digital conductivity meter) fixed at a given location in the tank. The mixing time is considered as the time at which the measured Concentration of the tracer reaches to within 95 to 98% of the final concentration. The transient variation in the concentration was used for the estimation of θmix. In general, under turbulent flow conditions, θmix is inversely proportional to the impeller speed, and the product N3 θmix known as dimensionless mixing time is used as a performance parameter.

In general, for a given tank diameter θmix $\alpha$ $1/D^2$. Thus, variation in the impeller diameter modifies the flow pattern (relative magnitudes of convective and turbulent motions and relative magnitudes of axial and radial mean components) and hence also the mixing efficacy. This also means that for the conventional impeller systems, impellers with larger D and lower NP are more beneficial.

However, it is necessary to avoid a too large impeller diameter that can inhibit the secondary flow. Also, since generating a relatively larger radial component of the mean velocity results into large energy dissipation at the wall and thus lowers the mixing efficiency, it is always preferred to avoid such a situation. Further, a larger impeller diameter demands higher torque and hence higher capital cost. Hence, the selection should be made on the basis of capital and operating costs. While these observations are valid for the conventional impellers, it does not necessarily apply for the FI. Hence experiments were carried out to understand the characteristic mixing time for a FI.

Figure 6:
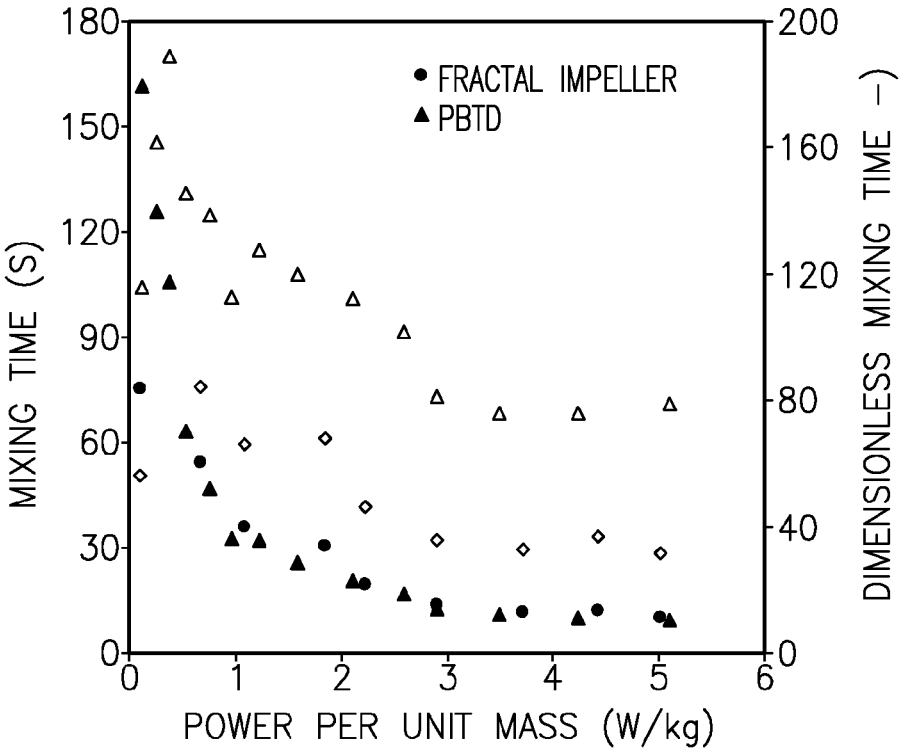
FIG. 6 graphically depicts variation in dimensionless mixing time with PW for fractal impeller and power consumption per unit mass (θmix vs Pw)
Figure 7:
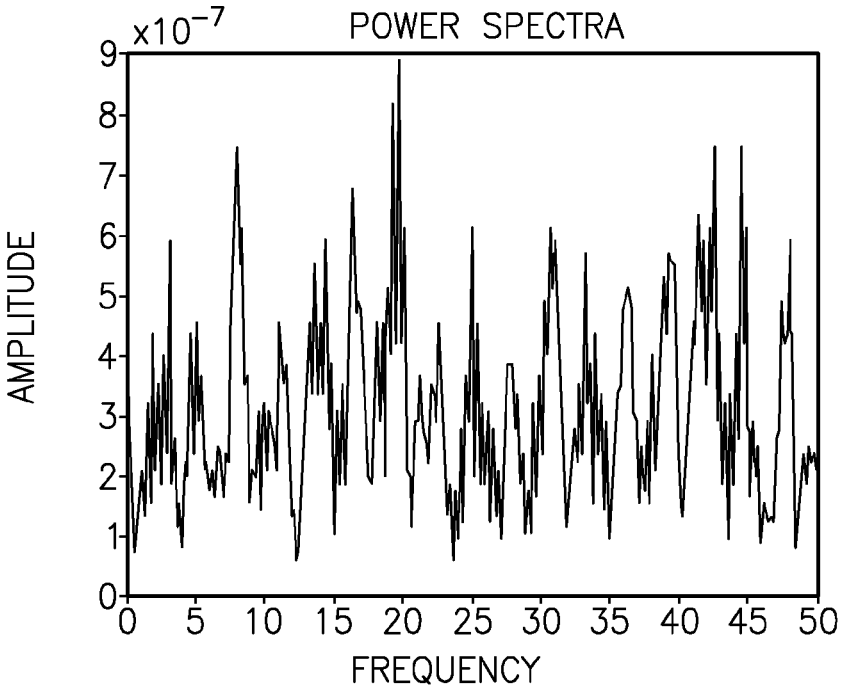
FIG. 7 graphically depicts the Fourier spectrum of the transient torque data for N=100 rpm, the Fourier spectrum of the transient torque data for N=(θmix vs Pw) and the open symbols indicate the 100 rpm dimensionless mixing time and the closed symbols indicate the actual mixing time(s)

The conductivity signal was smoothed to eliminate the spurious effects due to data acquisition noise, and the smoothed signal was analyzed to measure the mixing time. The mixing time at identical N for PBTD was 2 to 3.5 times higher than the FI. This particular situation can again be explained on the basis of the existence of fractal structure which develops self-similar flow structures in the entire vessel and hence a uniform randomness. As a result, the tracer gets continuously distributed in several mixing zones existing in the reactor due to the fractal structure of the impeller, and it helps achieve better mixing. However a comparison of the θmix variation as a function of the PW shows that both impellers have similar performance (FIG. 6). Experiments were also carried out to measure the mixing of a tracer liquid in the bulk viscous liquid (50% glycerol solution). In this case, the mixing time was 40% higher than that of water, and this observation was consistent over the entire range of impeller rotation speed for FI. Mixing time was also measured for different solid loadings for the suspensions and the dimensionless mixing time showed a positive dependence on the solid loading. This observation is consistent with an increase in the solid loading; the bulk viscosity and density increase thereby leading to enhanced viscous forces, higher drag, and hence a longer mixing time. The fact that the presence of number of blades and mixing zones would create a uniform randomness was verified by taking the fast Fourier transforms of the acquired time series of the torque data. The resulting power spectra for one such experiment with N=100 rpm is shown in FIG. 7.

It can be clearly seen that unlike the literature information on variety of conventional impellers, where the impeller rotation frequency, blade passage frequency are prominently seen in the power spectra, in the case of a FI no specific dominance was seen. The power distribution over a range of frequencies showed similar features and thus support the notion that with the help of such a self-similar structure for mixing of fluids, one can attain a uniform randomness in the flow at different scales, and no specific instabilities (associated with certain frequency) exist that are usually considered to promote spatial mixing. Thus, the scaling effects can be minimized by achieving local mixing effects, and the principle of self-similarity can be maintained to achieve similar performance even in the scale-up of such systems.

(c) Solid Liquid Suspension:

The FI was also used for checking its ability to suspend solid particles. Two different types of particles were used: (i) resin particles (Fs=1080 kg/$m^3$) of the particle size in the range of 350 to 500 μm and (ii) glass bead particles (Fs=2500 kg/$m^3$) of diameter 250 μm (6 μm) in tap water (FW≈1000 kg/$m^3$). For the case of resin particles the local particle concentration at different distances from the bottom of the tank was measured, and for the suspension of glass particles, cloud height was measured. A SS316 straight tube (4.5 mm outer diameter and 3 mm inner diameter) was used to collect the resin particles locally, and their mass was measured to estimate the local solid mass fraction.

No external suction was used to capture the particles as that would affect the local flow. The flow pattern from an axial flow impeller is conducive to easier suspension than that of by a radial flow impeller, while the mixed flow impellers show an intermediate performance. Suspension of solids in liquid in a stirred tank reactor has been studied over many decades, and certain guidelines on the selection of suitable impeller are known. Typically weak recirculation induced loops occur just below the impeller and also at the junction of the tank base and the wall. For the case of the impeller operating close to the tank base, the efficiency of energy transfer from impeller to particles is maximum. The particulate mass trapped in the stagnant zone below the impeller is, therefore, easily driven to the corners with enough velocity to get suspended. If the off-bottom clearance of the impeller is increased, then the stagnant zone below the impeller also increases and more particles get accumulated there. In such cases, higher impeller rotation speed would be needed to lift the particles from the bottom and then get completely suspended at further greater impeller rotation speeds.

Figure 3A:
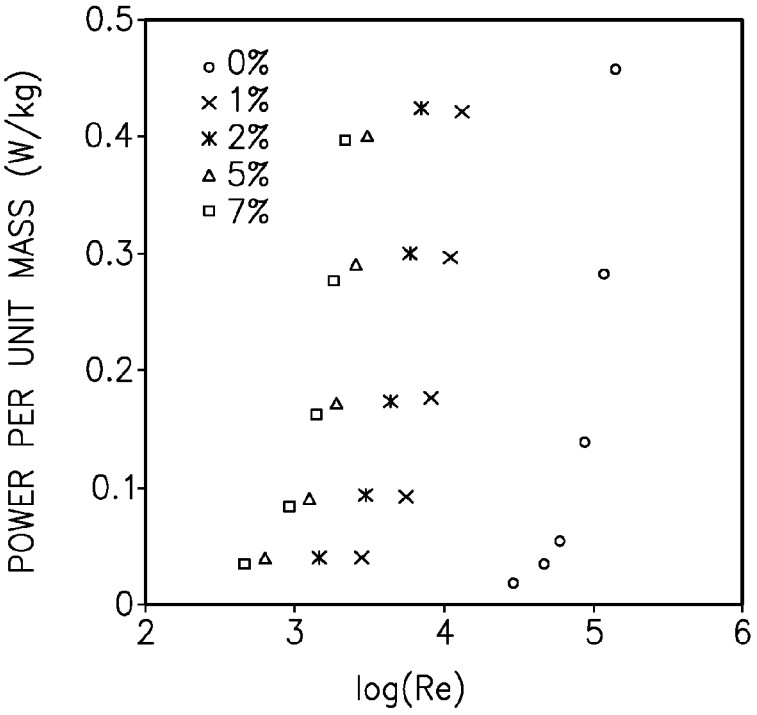
FIG. 3A graphically depicts PW for a fractal impeller for different solid loadings in the tank. The values of Re at different solid concentrations based on the slurry density and viscosity and impeller power number (Np)
Figure 3B:
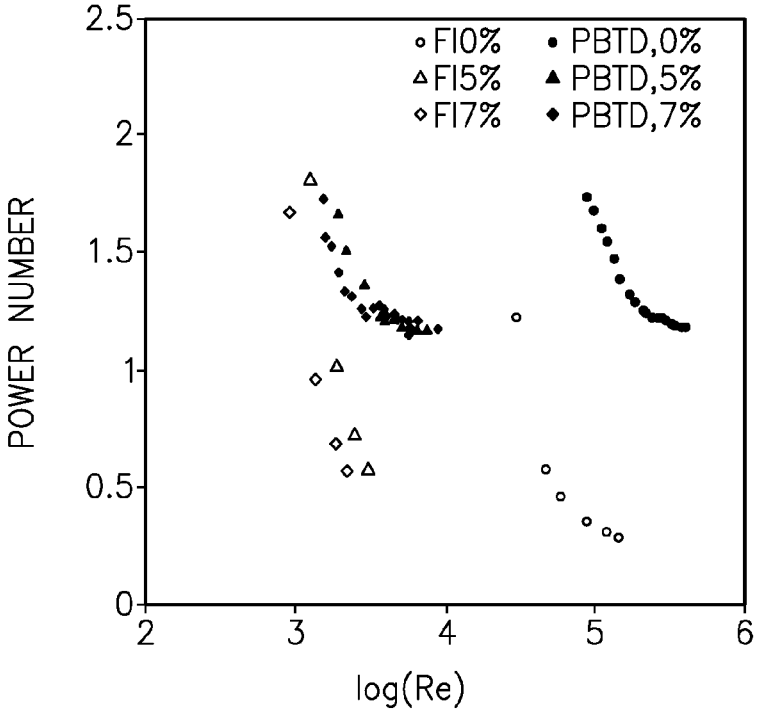
FIG. 3B graphically depicts variation in the impeller power number Np with an impeller Re for different solid loadings where open symbols belong to fractal impeller (FI) with experiments were limited for lower impeller speed as the particles were completed suspended and there was no need for experiments at higher Re and the filled symbols correspond to pitched blade down flow turbine (PBTD)

The flow generated by the FI is largely a tangential flow as all the blades simply cut the fluid in different planes thereby avoiding any possibility of sweeping or pushing the fluid in its path. Thus, the flow separation over the blades is a prominent phenomenon, and the fluid interacting with different rotating zones mix with each other. This results in a strong tangential flow at the bottom of the impeller, and thus helps to lift the particles while pushing them toward the wall; however, once these particles are lifted, they are trapped in the rotating structure which keeps the particle floating between different zones. Also, the velocity gradients in the vicinity of the blade were seen to help get the particles lifted in the direction perpendicular to the motion of the blade. For different suspension densities of the resin particles, the value of PW was seen to increase with increasing impeller Re. (FIG. 3A) and at all suspension densities, the following relation was seen to hold:

$$PW = C1\epsilon 1.34 Re 1.5 \quad (1)$$

where the value of C1 is $2.63\times10^{-7}$ and would strongly depend on the physical properties of the suspended particles (volume, density, shape, etc.). Re was estimated using the fluid density and viscosity at different solid mass fraction ϵ (%). With increasing ϵ (%), Re continued to decrease, and the corresponding variation in the estimated NP values is shown in FIG. 3B. Interestingly, on comparing the data with similar solid concentration for a stirred tank of 1 m diameter with PBTD, the FI showed much lower power numbers even with solid particles. Importantly, the Re range for which the complete suspension was achieved using a FI was at least less than 50% than that of PBTD. Here, by complete suspension, we refer to the situation where the particles are suspended in the entire liquid phase and there remains only a negligible fraction at the bottom of the tank. However complete suspension does not mean uniform spatial distribution of particles.

Figure 4A:
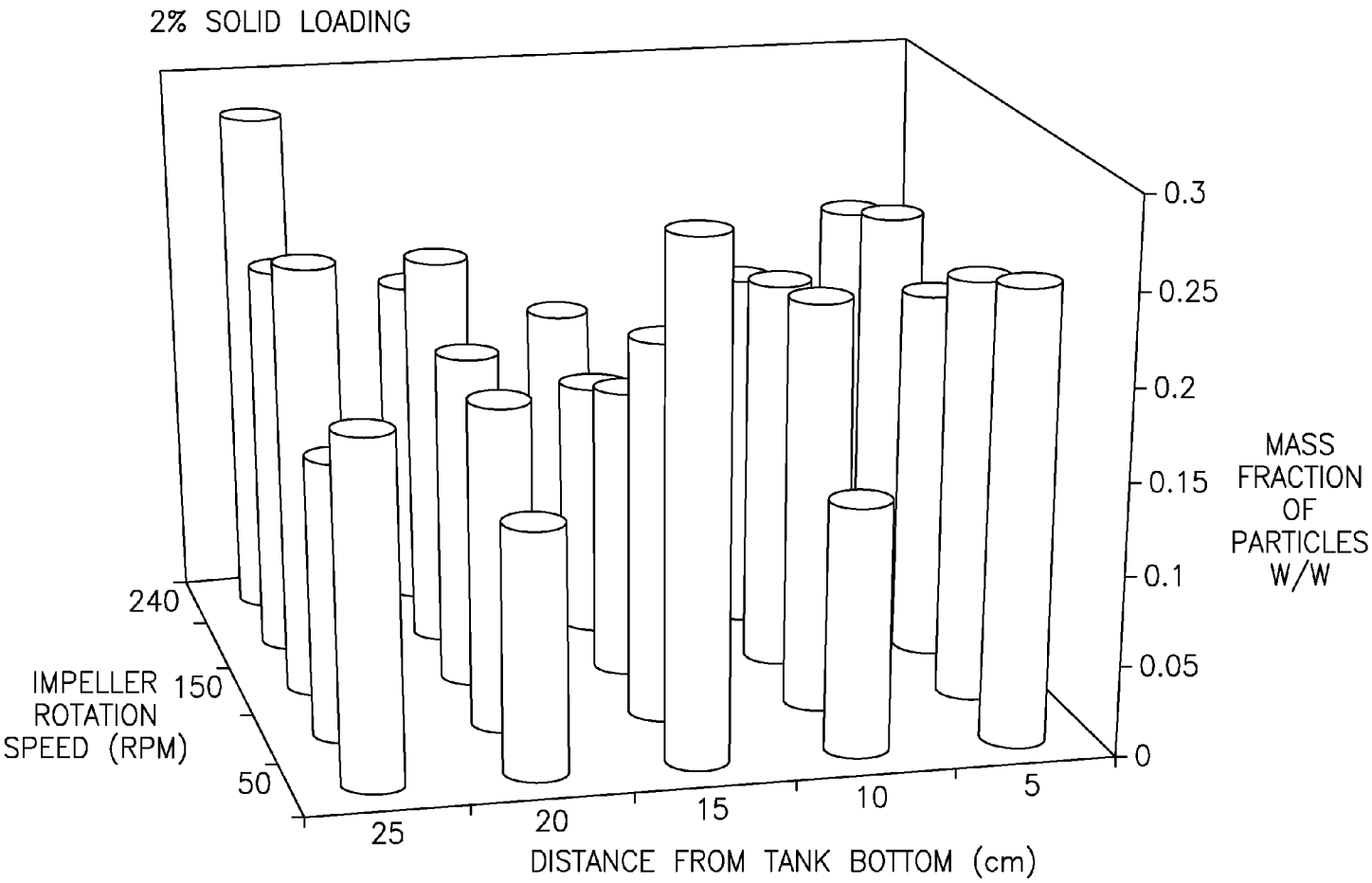
FIGS. 4A-4C graphically depict variation in the solid phase mass fraction at different impeller rotation speeds and at different solid loadings from bottom to the top of the tank.
Figure 4B:
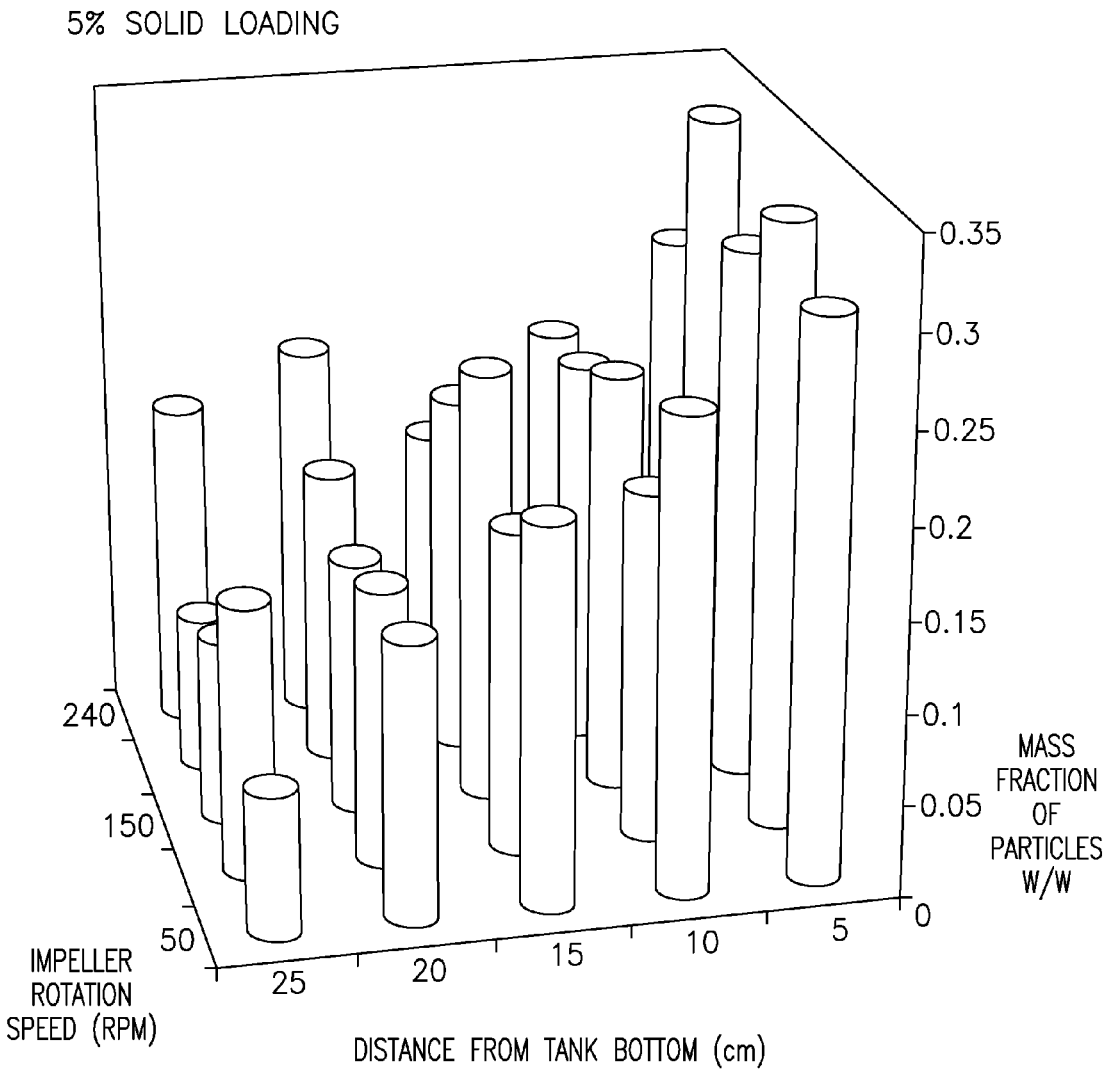
Figure 4C:
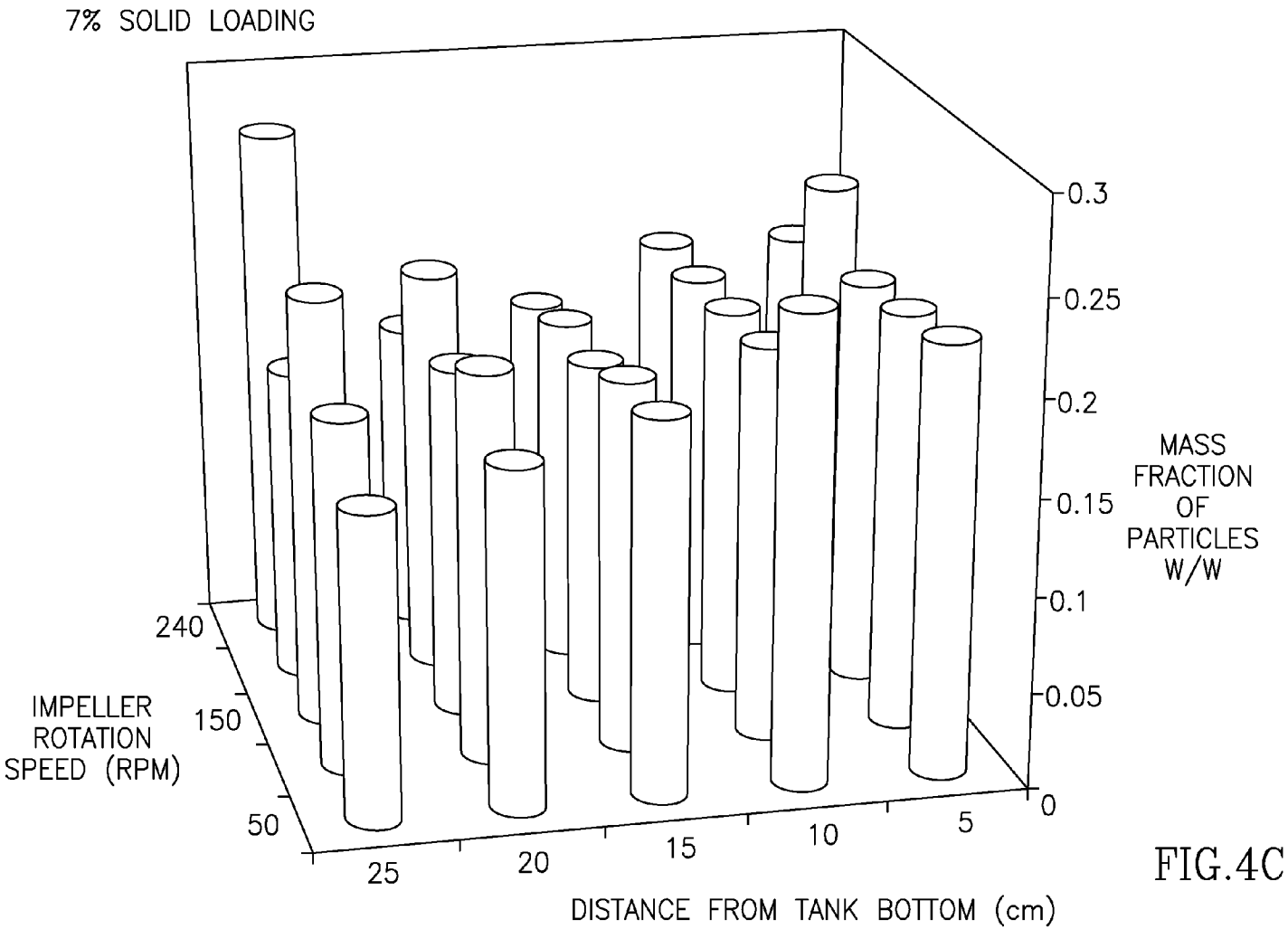

In addition to PW, uniformity in the solid concentration in the suspension would help to quantify the performance of this impeller. To understand the level of suspension (particle cloud) in the liquid, the local concentration of solid particles at various levels from the bottom of the tank was measured at different impeller rotation speeds. The variation in the local particle mass fraction is shown in FIG. 4. For all solid loadings, for less than 70 rpm, most of the particles were close to the bottom and were far from being lifted. At higher impeller rotation speed, the local solid mass fraction was well suspended with a standard deviation of ±3%. Thus, for all $\epsilon$ values, an impeller rotation speed of 100 rpm was sufficient to keep all the particles in suspended condition. On achieving complete suspension, for $\epsilon$=5%, the local solid concentration decreased slightly from bottom to top of the stirred tank, while for $\epsilon$=7%, it was slightly higher toward the bottom as well as at top of the tank The relatively large volume of the FI results in a better effect in keeping the particles suspended. Importantly, the presence of multiple blades in the section close to the bottom develops a strong tangential flow, which helps the particles to experience lift in the direction perpendicular to the motion of the blades. On the other hand, the localized vortex generated due to the motion of the blades perpendicular to the bottom helped lift the particles in the center of the stirred tank. This vortex was seen to have a periodic behavior and details will be studied by measuring the local velocity field. Further, unlike the circulation cells that get developed in the tank with conventional impellers (DT and PBTD), in the presence of multiple blades and self-similar behavior at different levels of the geometry of the FI, no such circulation cycles were visible. As a result, the particles lifted from the bottom remain mostly floating between different branches of the impeller thereby reducing the extent of non-uniformity in the suspension quality. At any given tank cross section, at different impeller rotation speeds, the variation in the particle mass was largely due to the local regions generated by the interaction of flow domains from different blades in different branches. With increasing particle loading, the extent of uniformity in the suspended particle concentration also increased. In the case of a PBTD, two different circulation loops, one below and another above the impeller are established. Unlike this, in the FI, higher solidity practically breaks such loops and develops several networks of zones which interact with each other. This also helps to keep the particles suspended while being transferred from one zone to another self-similar zone.

Figure 5A:
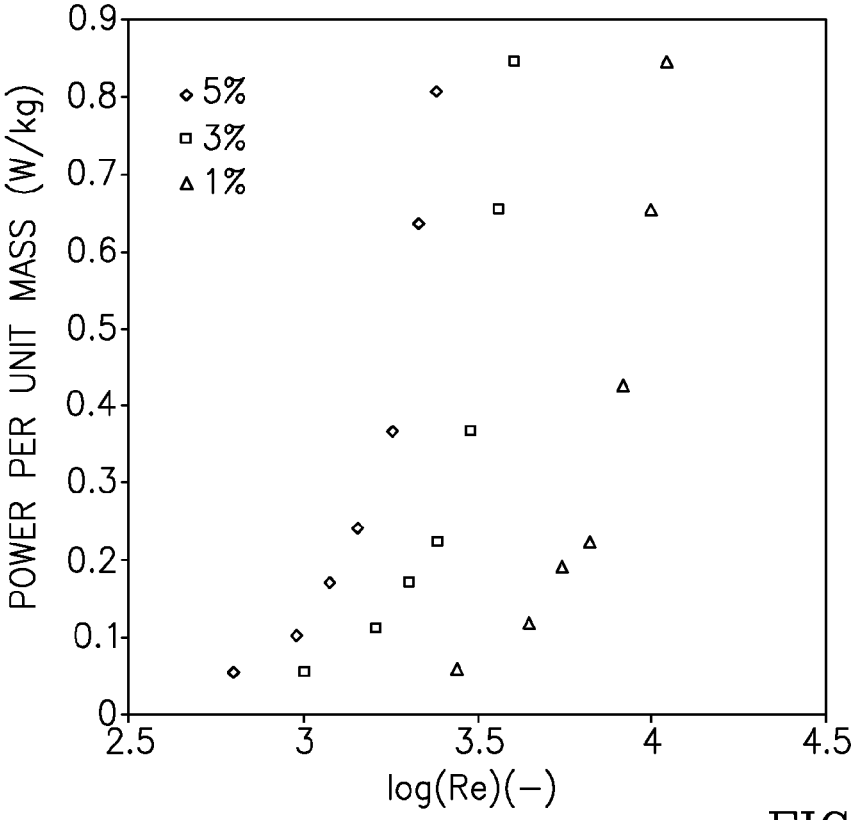
FIG. 5A graphically depicts PW for FI and pitched blade down flow turbine different solid loadings of glass particles in the tank and values of Re at different solid concentrations, which are estimated on the basis of the slurry density and viscosity.

In another set of experiments, the performance of FI for suspending solid glass particles was studied. The PW variation for different glass particle suspension densities is shown in FIG. 5A. While the nature of plots is similar to that of FIG. 3, the value of PW at similar impeller rotation speed is almost twice that of the suspension of particles with density 1069 kg/m$^3$. This extent of difference is almost equivalent to the settling velocity of these particles in water, which is proportional to their densities. On measuring the cloud height for suspension of glass particles, it was seen that the extent of lifting of the particles in the bulk increased with increasing suspension density. This implies that the increase in power consumption at higher suspension densities was indeed utilized in suspending particles. Visual observations showed that at very low suspension density, the particles always remained in the lower half of the impeller. This was largely because the particles were seen to remain entrapped in the smaller mixing zones formed by the blades of fractal impeller. This observation was also seen for higher suspension density, but at lower impeller rotation speed (<100 rpm) the particles were seen to get aligned in a peculiar manner at the tank bottom, in two lines each connecting the diagonally opposite baffles. On increasing impeller speed, they eventually get suspended. This indicates that at lower N, the confluence of radial flow, tangential flow, and the presence of baffles makes the particles to assemble in a specific manner. At higher suspension density (5%), the particles were seen to get easily suspended, which is not very common largely because of the variation in the bulk property which helped the particles get suspended easily. Equation 1 was seen as valid even for the suspension of glass particles with the value of $C1=5.5\times10^{-7}$.

Figure 5B:
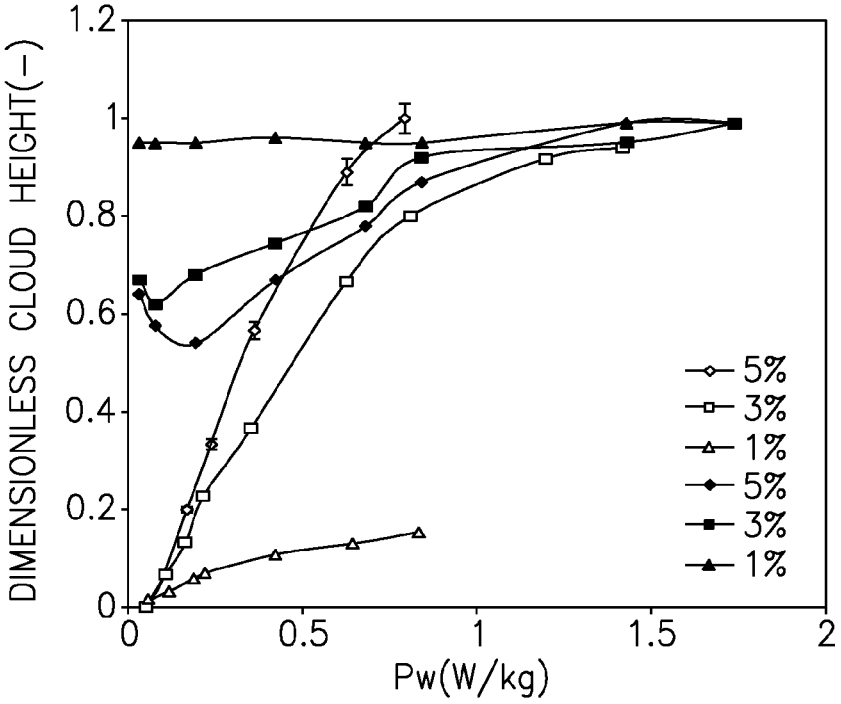
FIG. 5B graphically depicts dimensionless cloud height vs power consumption per unit mass of the contents for the case of FI and pitched blade down flow turbine for glass particles of identical size where the open symbols correspond to FI and the closed symbols correspond to power consumption per unit mass.

The performance of suspending identical glass particles in a stirred tank using FI and PBTD (in a large tank having identical T/H ratio) is shown in FIG. 5B. The observations for three different solid concentrations can be summarized as follows:

(i) At 1% solid concentration, PBTD performs much better than FI in suspending particles even at very low impeller speed;

(ii) At 3% and 5% solid concentration, the power required for lifting of particles with PBTD is relatively lower than that of FI. With glass particles, the terminal velocity being higher, while achieving complete suspension was possible at lower PW: achieving uniform suspension needed relatively much higher power;

(iii) With 5% solid fraction, the FI is efficient in suspending particles at higher concentrations;

(iv) the trend in the efficiently suspending the particles at different solid concentrations for PBTD and for FI are exactly opposite.

These observations indicate that this novel impeller design is useful in efficiently suspending particles at higher solid loadings, which is not very easy with the conventional impellers.

Importantly, the solid concentration for glass particles along the height (measured in similar manner as for low density particles) when the dimensionless cloud height is 1 was very much uniform with a standard deviation of 6%.

(d) Gas Liquid Dispersion:

The FI was also used for dispersion of gas into liquid. It was carried out by sparging compressed air in the stirred tank using a ring sparger located at the bottom of the reactor. The sparger had 16 holes of 1 mm diameter spaced at equal distance. The superficial gas velocity was monitored and controlled using recalibrated Rota meter. The power consumption during the stirring at different impeller rotation speeds and over a range of superficial velocities was measured. The fractional gas hold-up was estimated from the difference in the height of dispersed liquid and clear liquid. The bubble size was estimated from the images obtained from a high speed camera (Red lake).

Figure 8A:
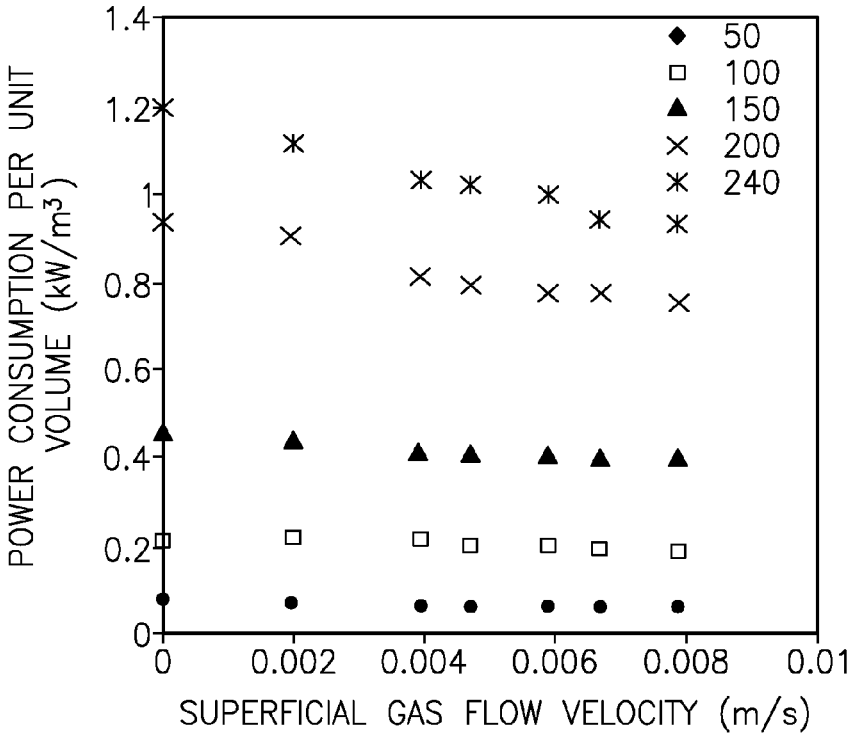
FIG. 8A graphically depicts the performance of FI for gas-liquid dispersion for gas flow velocity, rotation speed and flow number (power consumption vs. VG)

On measuring the power consumption per unit volume of the reactor, it was seen that the value of PW decreased continuously with increasing superficial gas velocity. For the case of conventional impellers, the gas loading reduces the power consumption due to the formation of cavities behind the impeller blades which modified the pumping action of the impeller. For the case of fractal impeller as well, the extent of reduction in power consumption in gas (PWG) was higher for higher impeller rotation speed as well as at higher gas flow rate (FIG. 8A).

Figure 8B:
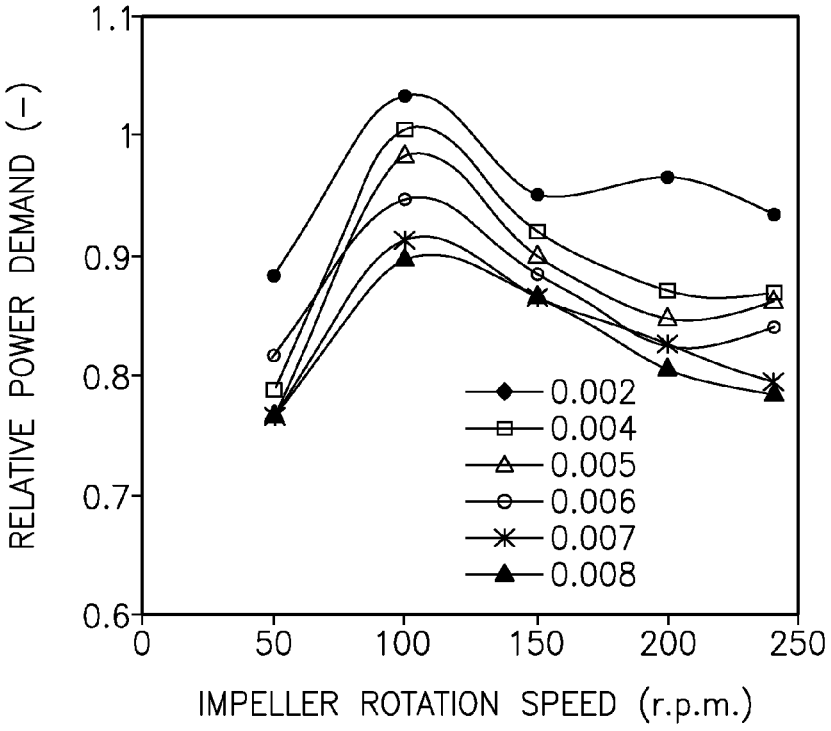
FIG. 8B graphically depicts the performance of FI for gas-liquid dispersion for gas flow velocity, rotation speed and flow number (RPD vs. impeller rotation speed)
Figure 8C:
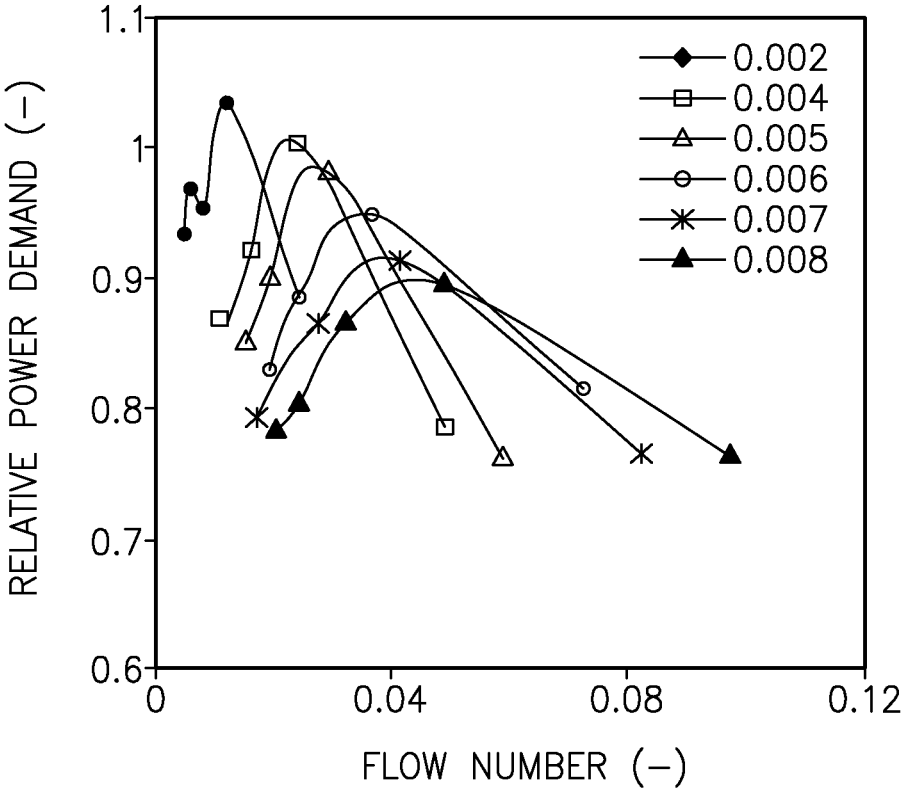
FIG. 8C graphically depicts the performance of FI for gas-liquid dispersion for gas flow velocity, rotation speed and flow number (RPD vs. flow number)
Figure 9A:
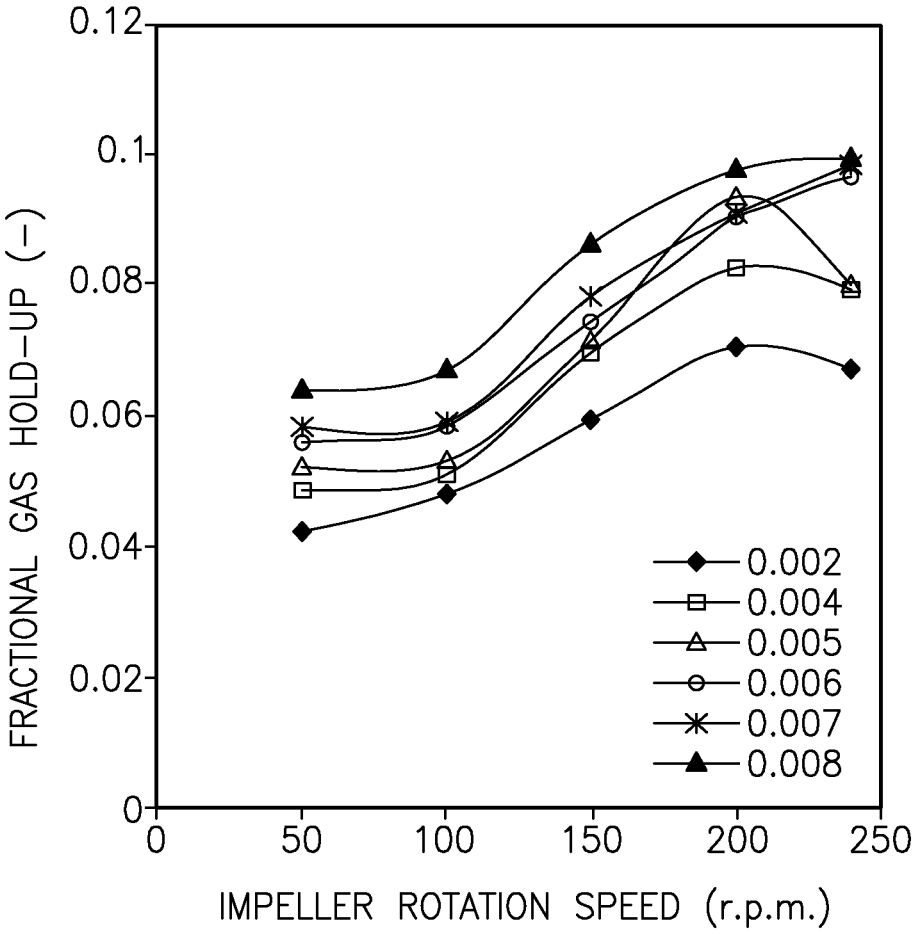
FIG. 9A depicts hydrodynamics of a stirred reactor with FI for gas-liquid system where variation in the fractional gas hold-up at different impeller rotation speeds and at different superficial gas velocities.
Figure 9B:
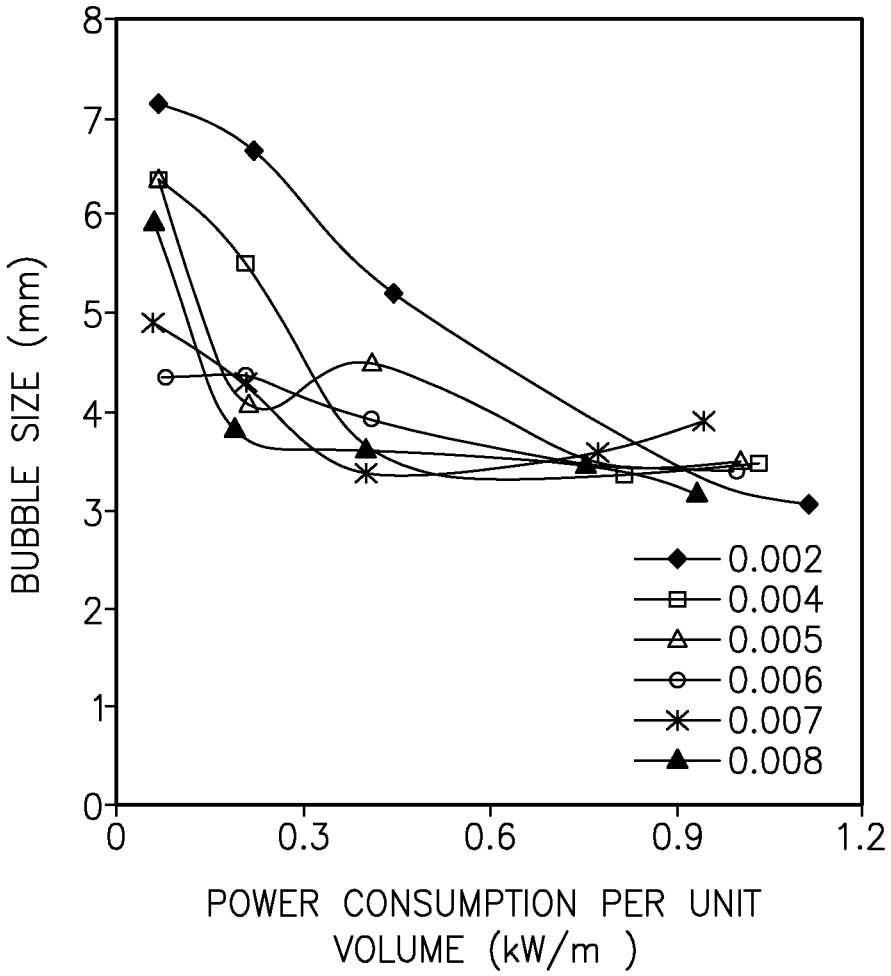
FIG. 9B depicts hydrodynamics of a stirred reactor with FI for gas-liquid system where variation in the average bubble size with power consumption at different superficial gas velocities.
Figure 10B:
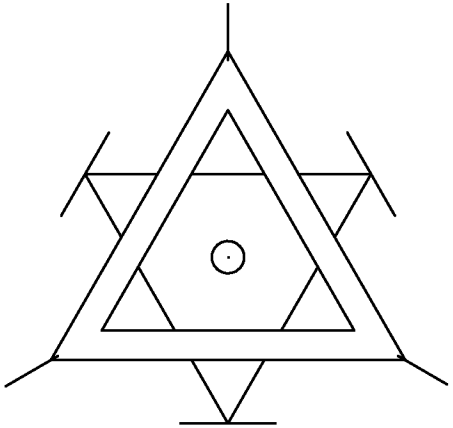
FIG. 10B depicts a top view of a schematic diagram of the impeller with three main branches, three sub-branches and blades at the end of each sub-branch.
Figure 10A:
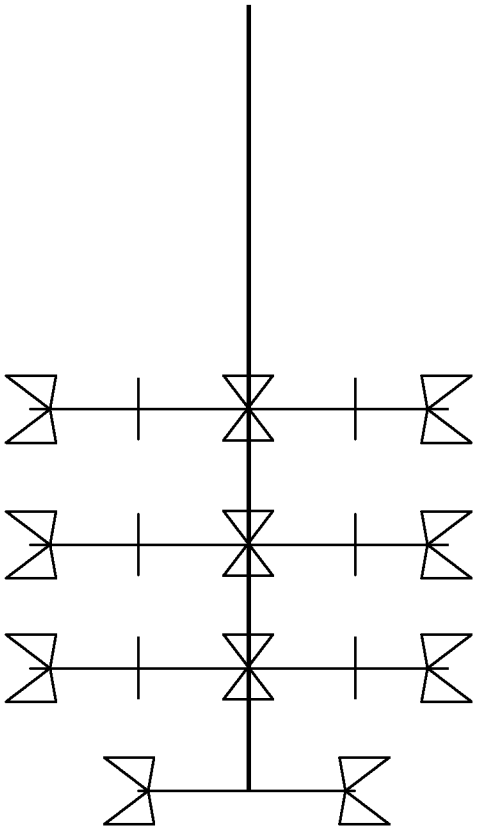
FIG. 10A depicts a front view of a schematic diagram of the impeller with three main branches, three sub-branches and blades at the end of each sub-branch.
Figure 11:
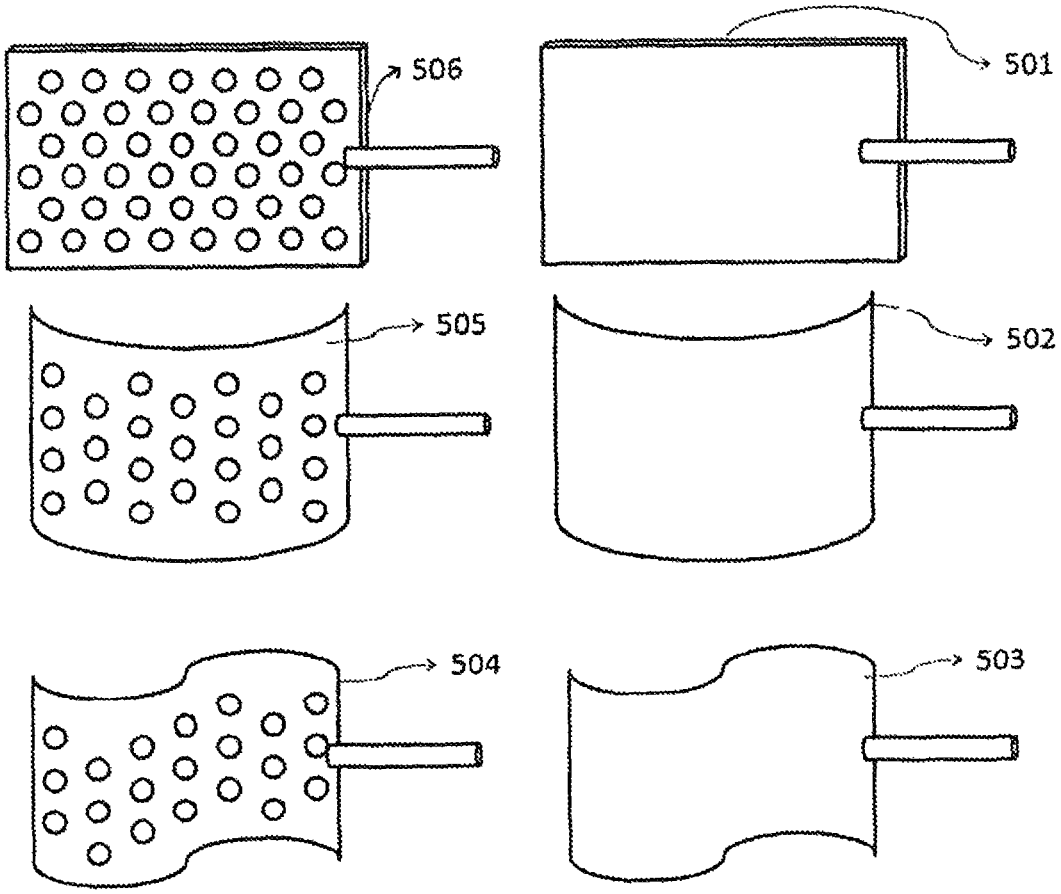

The relative power demand (RPD) 1.13 estimated as PWG/PW at a given VG was seen to go through a maximum (FIG. 8B). The overall values of RPD decreased with increasing VG. The plot of RPD vs flow number ($NQ=Q/ND^3$) clearly indicated a locus along which the RPD goes through a maximum value (FIG. 8C). Also, the RPD corresponding to the point of inflection decreased with increasing gas velocity. Values of RPD were seen to get well correlated (not shown here) with FI−0.2Fr−0.25, with the proportionality constant as a function of the dimensionless group (N·VG/g), where g is the acceleration due to gravity. The value of proportionality constant deviated from the 0.18 as reported for other standard impellers. One of the reasons for such a deviation is the spatial distribution of impeller blades, which will not support the use of a single value of impeller diameter. Thus, for example, the Froude number ($Fr=N^2D/g$) which depends on the tip velocity (ND) of the impeller: the variation in the tip distance from blade to blade will now allow a fixed value of the proportionality constant in estimating the RPD based on FI and Fr. Interestingly, in the FI, none of the blades actually sweep the fluid with it, and hence the possibility of formation of cavities is almost negligible. However for the case of gas-liquid dispersion, a thin gas layer was seen to stay below the horizontally flat blades yielding a compressible boundary layer that would help reduce the drag. This further helps in reduction in the actual power consumption. On comparing the variation in the Fr vs FI for a FI with that of a standard Rushton turbine, it is quite evident that for a FI, the flow is still in the regime where cavities are under formation and the possibility of flooding may occur at higher gas velocities. Such a comparison may look unrealistic as the behavior of FI and that of a Rushton turbine are very much different. On estimating the fractional gas hold-up at different impeller Re, the hold-up was seen to go through a maximum. However at all impeller rotation speeds, an increase in gas velocity resulted in an increase in hold-up (FIG. 9). The measured average bubble size decreased with increasing power consumption, which subsequently yielded higher effective inter facial area. Importantly, it was seen that the uniform dissipation of energy throughout the reactor helped yield very narrow bubble-size distribution.

ADVANTAGES OF THE INVENTION

The Fractal Impeller (FI) of instant invention, having self-similar structure leading to reduced drag in the absence of any possibility of wake formation behind the impeller blades helps to generate a uniform randomness throughout the stirred tank. Importantly, at identical N, although the Re for FI would be higher than that of a PBTD or DT, in reality the flow is laminar.

For suspensions, while the low density particles were seen to get completely suspended even at very low impeller rotation speed, the suspension of high density particles required only twice the amount of power for identical solid loading and impeller Re. The FI when used for gas-liquid dispersion showed that relative power demand continues to decrease with increasing impeller rotation speed as well as the superficial gas velocity. The bubble size distribution was very much narrow throughout the reactor supporting the hypothesis of possible uniformity in spatial energy dissipation. Different design alternatives with varied blade angles, etc. may yield better flow but at relatively higher power consumption. More details on the effect of design of FI on the performance for different applications are under investigation.

We claim:

1. A fractal impeller for a stirred tank reactor, comprising:

a shaft rotatable about an axis;

a plurality of main branches directly connected to the shaft;

a plurality of first sub-branches connected to said main branches, each of the first sub-branches having a plurality of blades connected thereto, including a first blade, a second blade, a third blade and a fourth blade, with the first blade and the second blade of each of the first sub-branches orientated perpendicular to the axis and the third blade and the fourth blade of each of the first sub-branches orientated parallel to the axis; and at least one second sub-branch that is directly connected to the shaft near one end of the shaft to aid in generating necessary flow in a region close to a bottom of the stirred tank reactor.

2. A fractal impeller of claim 1, wherein said impeller has at least three main branches and at least three first sub-branches.

3. A fractal impeller of claim 1, wherein each of the blades of the impeller are made of a flat sheet of different shapes and sizes.

4. A fractal impeller of claim 1, wherein each of the blades is rectangular, triangular, or circular, and wherein angular distances of between 8 to 16 degrees with respect to the axis about which the shaft is rotatable is covered by the blades vary and yield variation in a local blade passage velocity for a given impeller rotation speed.

5. A fractal impeller of claim 1, wherein all of the main branches are attached at a same location along a length of the shaft and an attachment distance is between 0.5 and 0.66 times the length of the shaft.

6. A fractal impeller of claim 1, wherein, when the stirred tank reactor has an aspect ratio that is greater than 1, the number of branches are equal to or lesser than a ratio of fluid height to a diameter of a tank in a reactor.

7. A fractal impeller of claim 1, wherein the impeller diameter is 1/1.58 times of a height of the stirred tank reactor.

8. A fractal impeller of claim 1, wherein power number ranges of the fractal impeller are between 0.35 and 0.6.

9. A fractal impeller of claim 1, wherein an operating control speed of the fractal impeller is in a range of $1.66<N<2.33$ rotations per second.

10. A fractal impeller of claim 1, wherein the fractal impeller has a self-similar geometrical structure resulting in reduced drag in an absence of any possibility of wake formation behind said blades to help generate a uniform randomness throughout said stirred tank reactor.

11. A fractal impeller of claim 1, wherein the blades are spaced from each other and do not overlap each other.

* * * * *